US006379186B1

(12) United States Patent
Shi et al.

(10) Patent No.: US 6,379,186 B1
(45) Date of Patent: Apr. 30, 2002

(54) ELECTRICAL CONNECTOR WITH METAL SIDE MEMBERS

(75) Inventors: GuangXing Shi; Qiang Chen, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,791

(22) Filed: Dec. 29, 2000

(30) Foreign Application Priority Data

Nov. 17, 2000 (TW) ..... 89219996 U

(51) Int. Cl.[7] ..... H01R 13/648
(52) U.S. Cl. ..... 439/607; 439/569
(58) Field of Search ..... 439/607, 101, 439/108, 608–610, 566, 569

(56) References Cited

U.S. PATENT DOCUMENTS 5,876,247 A * 3/1999 Hashimoto ..... 439/607
6,042,398 A * 3/2000 Wu et al. ..... 439/607
6,050,852 A * 4/2000 Wu ..... 439/607
6,224,422 B1 * 5/2001 Zhu et al. ..... 439/607

* cited by examiner

*Primary Examiner*—Hien Vu
(74) *Attorney, Agent, or Firm*—Wei Te Chung

(57) ABSTRACT

An electrical connector (100) comprises a housing (1), a number of terminals (2) retained in the housing, and a pair of metal members (3). The housing includes a base (10) and a mating board (12) projecting upwardly from the base. Each metal member includes a pair of metal walls (30) secured to the base, and a pair of metal soldering pads (33). Each wall has an upper portion (303) projecting beyond the base and three lower appendages (31) and two latches (32) extending downwardly from the upper portion into corresponding slots (114) defined at lateral sides of the base. During the high-temperature process of soldering the soldering tails to a printed circuit board, the metal walls strengthen the base. Longitudinal distortion of the base is thereby minimized. Accordingly, coplanarity of the terminals and quality of soldering is maximized.

6 Claims, 3 Drawing Sheets

ELECTRICAL CONNECTOR WITH METAL SIDE MEMBERS

CROSS-REFERENCES TO RELATED APPLICATIONS

This application is a copending application of U.S. patent application titled "ELECTRICAL CONNECTOR WITH METAL SIDE MEMBERS AND METHOD OF PRODUCING SAME" by the same inventors and assigned to the same assignee of the present application.

BACKGROUND OF THE INVENTION

1. Field of the Invention

The present invention relates to an electrical connector, and particularly to an electrical connector with metal members located at lateral sides of a housing of the connector for improving coplanarity of terminals of the connector.

2. Brief Description of the Related Art

A conventional connector usually includes a base with a plurality of terminals insert molded on a tongue board, and a pair of insulative sidewalls which project upwardly from lateral sides of the base and are parallel to the tongue board. The base is insert molded with the terminals, and then the sidewalls are insert molded to the base. This two-step insert molding procedure is unduly time-consuming and costly. Moreover, the plastic sidewalls acquire stresses during the second insert molding step. When the terminals are subsequently soldered to a printed circuit board, the sidewalls longitudinally deform to dissipate the stresses. Coplanarity of the terminals is degraded, and thus the quality of soldering is reduced.

Hence, an improved electrical connector is required to overcome the disadvantages of the prior art.

BRIEF SUMMARY OF THE INVENTION

A main object of the present invention is to provide an electrical connector with a pair of metallic walls for ensuring coplanarity of terminals of the connector.

To achieve the above-mentioned object, an electrical connector of the present invention includes a dielectric housing, a plurality of terminals retained in the housing, and a pair of metal members secured to the housing.

The housing includes a base, a mating board projecting upwardly from the base for engaging with a complementary connector, and two rows of recesses defined at opposite sides of the base. Each metal member has a metal wall secured in the corresponding recesses and a metal soldering pad extending from the metal wall for soldering to a printed circuit board. During the high-temperature process of soldering the soldering pads of the connector to the printed circuit board, the metal members support any melting plastic. Longitudinal distortion of the base is thereby minimized. Accordingly, coplanarity of the terminals and quality of soldering is maximized.

In a second embodiment of the invention, the soldering pads are separated from the walls, and are interferingly engaged with the base.

Other objects, advantages and novel features of the present invention will become more apparent from the following detailed description of the preferred embodiments when taken in conjunction with the accompanying drawings.

DETAILED DESCRIPTION OF THE PREFERRED EMBODIMENT

Figure 1:
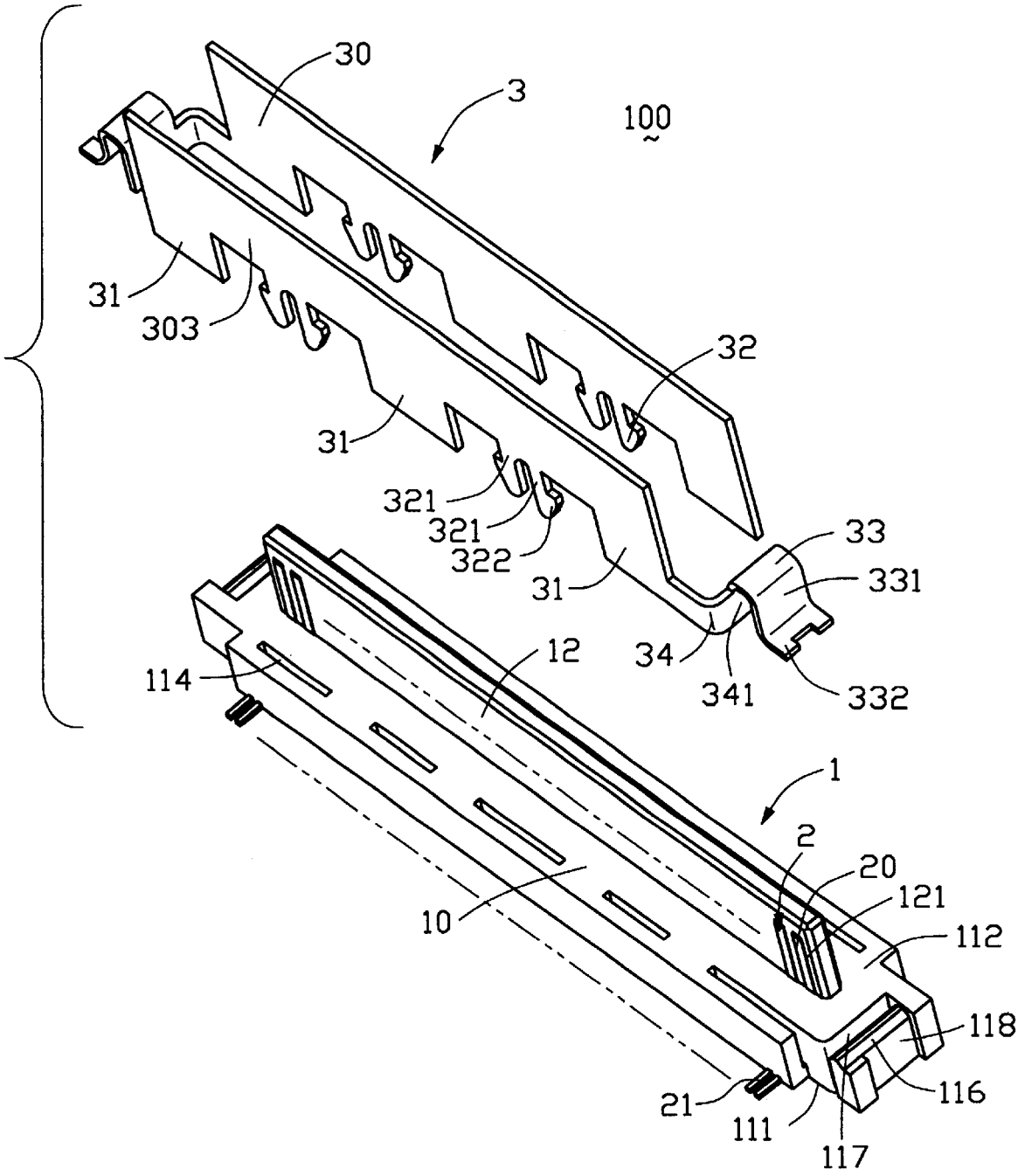
FIG. 1 is a partially exploded view of an electrical connector of the present invention.
Figure 2:
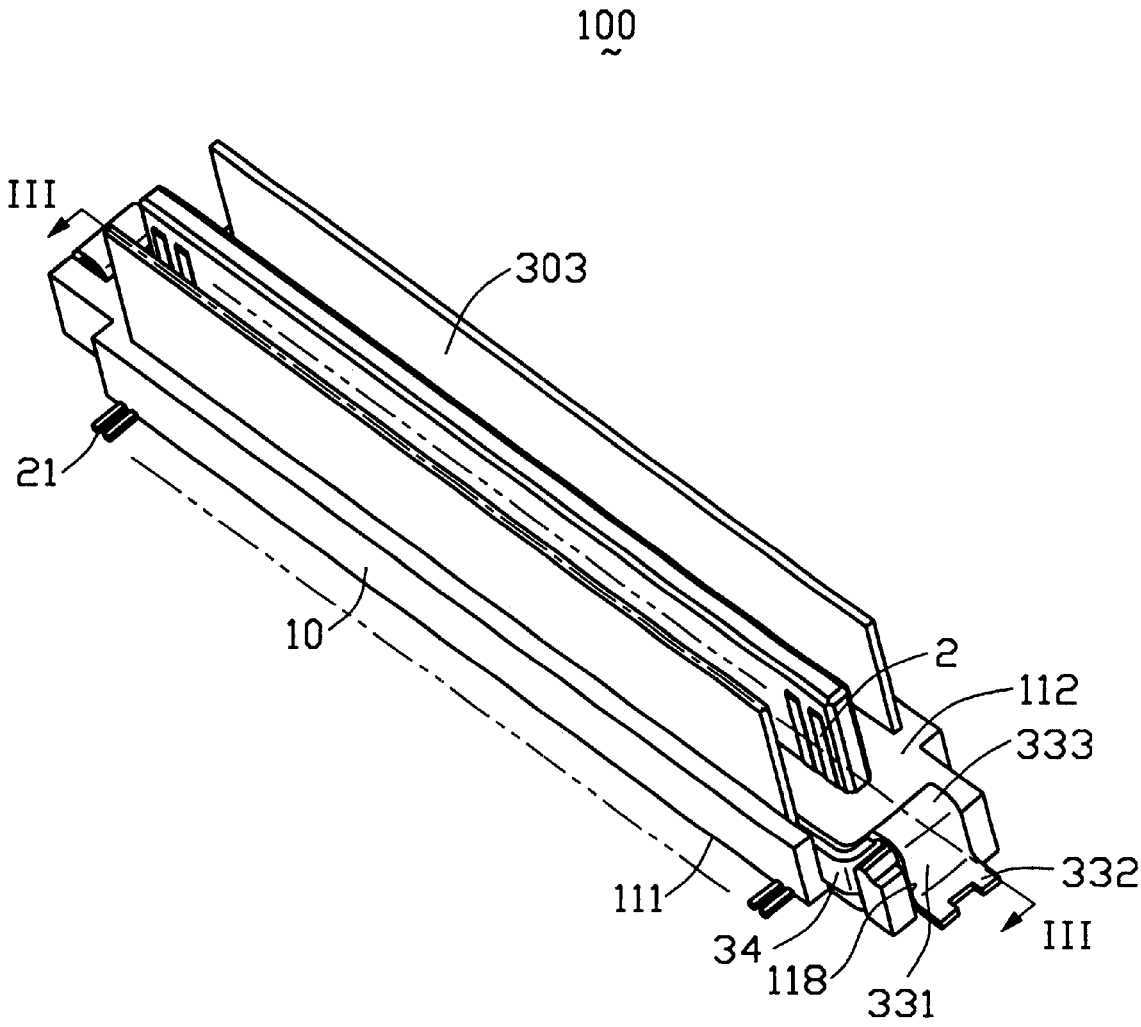
FIG. 2 is a perspective view of the connector of FIG. 1.

Referring to FIGS. 1 and 2, an electrical connector 100 of the present invention comprises a dielectric housing 1, a plurality of terminals 2 secured in the housing 1, and a pair of metal members 3 mounted on the housing 1.

The housing 1 defines a base 10 and a mating board 12 projecting upwardly from the base 10. The base 10 defines a mounting surface 111 for mounting on a printed circuit board (not shown), and an engaging surface 112 opposite the mounting surface 111. A plurality of slots 114 is defined along each lateral side of the base 10.

Each terminal 2 include a mating end 20 and a soldering tail 21 protruding outwardly from a bottom of a corresponding lateral side of the base 10 for soldering to the printed circuit board by surface mounting technology (SMT). The mating ends 20 are arrayed along opposite sides of the mating board 12 for engaging with contacts of a complementary connector (not shown). The soldering tails 21 are arranged along the mounting surface 111 and beneath the metal members 3.

Figure 3:
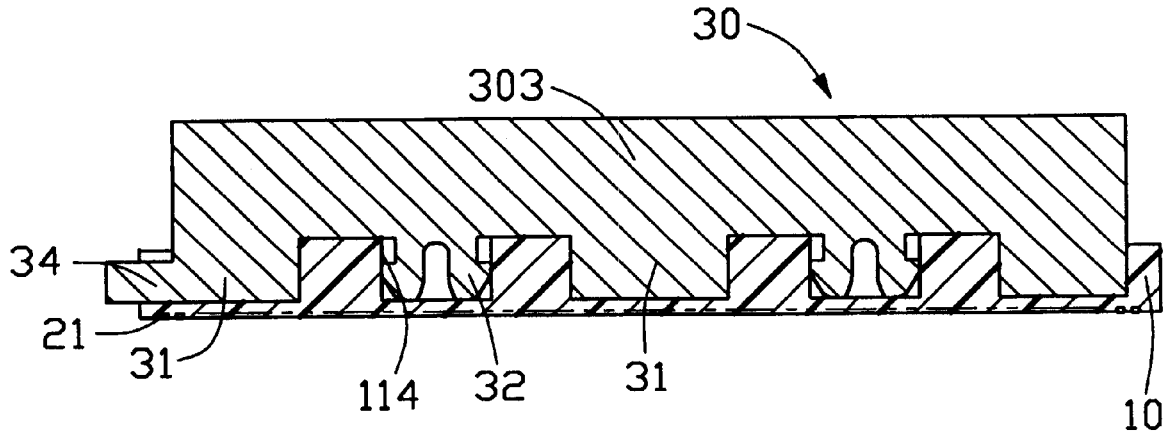
FIG. 3 is a cross-sectional view taken along line III—III of FIG. 2.

Each metal member 3 comprises a metal wall 30, a bridge 34, and a soldering pad 33 connected to the wall 30 by the bridge 34. Each wall 30 includes an upper portion 303 and three lower appendages 31 and two latches 32 extending downwardly from a lower edge of the upper portion 303 between the appendages 31. Each latch 32 consists of a pair of resilient legs 321 and a pair of projections 322 respectively formed on opposite edges of the legs 321 for interferingly engaging with the base 10. As is best shown in FIGS. 2 and 3, each wall 30 is secured to the base 10 by extending the lower appendages 31 and the latches 32 into corresponding slots 114 in which the upper portion 303 protrudes upwardly from the mating surface 112 for mating with a shield (not shown) of a complementary connector. The projections 322 bite into the base 10 and the lower appendages 31 are snugly fitted within the slots 114. The metal walls 30 not only function to guide insertion of a complementary connector into the connector 100, but also function to shield the terminals 2.

The bridge 34 includes an inner extension 341. Each soldering pad 33 includes an arced section 333 extending outwards from a top of the inner extension 341. A foot 331 depends from the arced section 333. A horizontal soldering section 332 extends outwards from a bottom of the foot 331. The housing 1 further forms a seat 116 at an outside of each opposite end of the base 10, wherein a slit 117 is defined between the base 10 and each seat 116. Each seat 116 defines an outward facing groove 118. The inner extension 341 of the bridge 34 is received in the slit 117. The arced sections 333 sit on a top of the seats 116 while the feet 331 are fitted in the grooves 118 and the soldering sections 332 project outwards from a bottom seat 116 for soldering to a grounding trace of the printed circuit board.

The connector 100 is soldered to the printed circuit board under a high temperature about 200° C. Even at this temperature, the longitudinally extending metal members 3 remain solid and strengthen the housing 1. Thus longitudinal distortion of the housing 1 is effectively minimized, whereby coplanarity of the soldering tails 21 can be effectively maintained during soldering process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric housing including a base and a mating board projecting upwardly from the base for engaging with a complementary connector, the base defining a plurality of slots along a lateral side thereof, the base having a mating surface and a mounting surface opposite the mating surface for mounting to a printed circuit board;

a plurality of terminals having mating ends arranged along opposite sides of the mating board for electrically engaging with contacts of the complementary connector, and soldering tails extending beyond the mounting surface for soldering to the printed circuit board;

a pair of metal walls secured to the base, each wall including an upper portion and a plurality of lower appendages extending downwardly from the upper portion, the upper portion protruding upwardly from the mating surface of the base and the lower appendages extending into corresponding slots and fittingly engaging the base; and a pair of soldering pads secured to opposite ends of the base and being substantially flush with the base for soldering to the printed circuit board;

wherein the soldering pads are respectively connected the walls by bridges; wherein each wall forms a pair of latches alternating with the lower appendages for extension into corresponding slots; and wherein each of the laches includes a pair of legs and a pair of projections located on opposite edges of the legs for interferingly engaging with the base to secure the walls to the base.

2. The electrical connector as claimed in claim 1, wherein the soldering tails outwardly extend from the walls, respectively.

3. The electrical connector as claimed in claim 1, wherein the housing further forms a seat at an outside of the base, a slit being defined between the seat and the base, the seat forming an outwards facing groove, each of the bridges having an inner extension, an arced section extending outwardly form a top of the inner extension, a foot extending downwardly form the arced section wherein a corresponding soldering pad is extended outwards from a bottom edge of the foot, the inner extension being fitted in the slit, the arced section sitting on the seat and the foot being fitted in the groove.

4. An electrical connector comprising:

an insulative housing including a base and a mating board upwardly extending from the base;

a plurality of slots formed in the base beside the mating board;

a plurality of terminals disposed in the housing; and a pair of substantially identical metal members commonly and symmetrically surrounding the mating board, each of said members including a metal wall and a solder pad integral with said metal wall, the metal wall extending upwardly above the base and retainably located along a longitudinal direction of the mating board, said solder pad located at a longitudinal end of the housing, and a bridge connected between the corresponding solder pad and metal wall; wherein the solder pad includes an arced section extending outwardly from a top of said bridge, a foot downwardly depends from said arced section, and a horizontal solder section extends outwardly from a bottom of the foot;

wherein said metal wall includes latches retainably received within the corresponding slots; and wherein each of the latches includes a pair of legs and a pair of projections located on opposite edges for interferingly engaging with the base to secure the walls to the base.

5. The connector as claimed in claim 4, wherein said solder pad is generally flush with the base.

6. The connector as claimed in claim 4, wherein said metal wall includes appendages extending into the corresponding slots.

* * * * *